United States Patent [19]

Brandl et al.

[11] Patent Number: 4,930,400

[45] Date of Patent: Jun. 5, 1990

[54] MAGAZINE WITH LINKLESS CARTRIDGE FEED SYSTEM

[75] Inventors: Rudolf Brandl, Dornhan-Weiden; Heinz Matt, Oberndorf, both of Fed. Rep. of Germany

[73] Assignee: Heckler & Koch, GmbH, Oberndorf am Neckar, Fed. Rep. of Germany

[21] Appl. No.: 190,501

[22] Filed: May 5, 1988

[30] Foreign Application Priority Data

Jun. 30, 1987 [DE] Fed. Rep. of Germany ..... 3721527

[51] Int. Cl.[5] ..... F41C 25/02

[52] U.S. Cl. ..... 89/34; 89/33.14

[58] Field of Search ..... 89/33.14, 33.2, 33.16, 89/33.17, 33.25, 34

[56] References Cited

U.S. PATENT DOCUMENTS

| | | | |
|---|---|---|---|
| 1,412,287 | 4/1922 | Kovaleff | 89/33.14 |
| 1,719,126 | 7/1929 | Pfeiffer et al. | 89/33.14 |
| 1,800,594 | 4/1931 | Browning | 89/33.02 |
| 2,114,311 | 4/1938 | Nomar | 89/33.17 |
| 2,375,437 | 5/1945 | O'Hare | 89/33.14 |
| 2,383,780 | 8/1945 | Dobremysl | 89/33.2 |
| 2,437,425 | 3/1948 | Goodhue et al. | 89/34 |
| 2,489,428 | 11/1949 | Mariner | 89/33.14 |
| 2,828,732 | 4/1958 | Horowitz et al. | 89/34 |
| 2,924,150 | 2/1960 | Maillard | 89/33.25 |
| 3,303,741 | 2/1967 | Christiansson | 89/34 |
| 4,034,644 | 7/1977 | Hupp et al. | 89/33.17 |
| 4,681,019 | 5/1988 | Brandl et al. | 89/33.14 |

FOREIGN PATENT DOCUMENTS

| | | | |
|---|---|---|---|
| 834485 | 11/1938 | France | 89/33.2 |
| 111650 | 8/1944 | Sweden | 89/33.17 |
| 25526 | of 1905 | United Kingdom | 89/33.2 |
| 629816 | 9/1949 | United Kingdom | 89/33.25 |

*Primary Examiner*—Charles T. Jordan
*Assistant Examiner*—Stephen Johnson
*Attorney, Agent, or Firm*—Helfgott & Karas

[57] ABSTRACT

A magazine includes a load opening and a linkless feed system which includes the following devices for manual loading with cartridges through the load opening, as well as for their automatic and sequential transport to a gun barrel. These devices include a cartridge receiving device movable manually in the load direction and automatically in the opposite, feed direction, a tensioning device engaging into the cartridge receiving device, pretensionable in the feed direction, and a device for automatic but releasable blocking of the feed system during the loading phase in the feed direction when the tensioning device is released, and/or in the loading direction when a cartridge gap appears in a cartridge receiving device behind the load opening.

13 Claims, 2 Drawing Sheets

MAGAZINE WITH LINKLESS CARTRIDGE FEED SYSTEM

BACKGROUND OF THE INVENTION

The invention refers to a magazine with a load opening and a linkless feed system according to generic concept of patent claim 1.

The feed system of the invention basically consists of a cartridge receiving device and of a tensioning device connected to the cartridge receiving device. The cartridge receiving device is movable in two directions: in a feed direction and in an opposite, load direction. During the firing phase the feed system delivers the cartridge automatically and sequentially in the feed direction to a gun. This is accomplished by pre-stressing the tensioning device in the feed direction and by its engagement with the cartridge receiving]device. On the other hand, during the loading phase, the cartridge receiving device is manually movable in the load direction via a handle. At this point the cartridges are arranged sequentially through the load opening on the cartridge receiving device. Due to the engagement of the cartridge receiving device with the tensioning device, the tensioning device is thus pre-stressed in the feed direction.

Such a magazine has already been developed by the applicant. In this prior art magazine the cartridge receiving device is embodied as an endless chain. Said chain consists of two parallel, endless chain strands connected by crossbars. The distance between the crossbars is matched with the diameter of the cartridge shells. This conveyer chain is introduced into a meandering magazine channel and extends around a sector of the tensioning device. The tensioning device basically consists of a drum, which in turn is automatically rotated by a spring drive in the direction corresponding to the feed direction. When the conveyor chain moves in the feed direction, the cartridges in the magazine are conveyed in the direction of a feed channel. An oblique surface is located before the feed channel to lift the cartridges from the conveyer chain and forward them into the feed channel. The foremost cartridge is held by the magazine lips at the discharge end of the feed channel at all times and is removed from there by the gun in an axial direction into the feed channel. When all sharp cartridges have been removed from the magazine, a blind cartridge firmly attached to the conveyer chain reaches the magazine lips. The magazine must be loaded at this point at the latest.

The conveyer chain moves in the load direction, opposite to the feed direction, for feeding this prior art magazine. The cartridges fed into the shaft-like load opening reach the magazine channel below and settle between two crossbars of the conveyer chain. The cartridges are usually fed into the load shaft with one hand; the other hand moves the conveyer chain in the load direction. The load shaft may also include two parallel shaft sections, so that two parallel cartridge rows are forwarded onto the conveyer chain.

Compared to a magazine with a cartridge belt, the magazine of the invention has the advantage of a more compact design due to the linkless feed system. In addition, it protects the cartridges better against outside influences. It also provides the rifleman with greater freedom, since he is not hindered by the loosely hanging cartridge belts. Finally, equipping an automatic weapon, i.e., an automatic rifle or an automatic pistol, with such a magazine results in a weight savings compared to a cartridge belt with the same number of cartridges.

SUMMARY OF THE INVENTION

An object of the invention is to provide a magazine of the type described in the introduction that would preserve, as much as possible, its previous advantages while assuring simple operation.

This and other objects are achieved by the magazine which of the invention is equipped with a device that blocks the feed system automatically, during the loading phase in the feed direction and/or in the load direction when a cartridge gap appears in the cartridge receiving device.

This blocking device, active only during the load phase, has the advantage that handhold can be released at any time for manual movement in the load direction of the cartridge receiving device and for simultaneous stressing of the tensioning device,e without the cartridges being moved automatically in the feed direction to the discharge opening of the magazine. A (short) release of this handhold may become necessary during loading when the cartridge receiving device must be moved manually over such a distance that this is no longer possible with a single hand position, but requires change of hand position. The need for release of the handhold in the case of a change in hand position arises specifically when only one hand is available, for example, when the other hand is introducing cartridges into the load shaft.

The block device has also the advantage that a possible cartridge gap can be detected even in the load opening. A cartridge gap may arise, for example, when cartridges are displaced from their normal position in the load shaft and/or the conveyer chain moves at a higher speed than the one with which cartridges can be fed.

The blocking device preferably consists of a first blocking means for blocking in the feed direction and a second blocking device, independent of the first one, for blocking the loading direction.

The mutual independence of both blocking means creates a greater operating safety of the same, since possible malfunctions of one means do not necessarily affect the other means.

For disabling both blocking means during the firing phase, a closing device brings the first blocking means into or maintains it in the non-blocking position. Also, the second blocking means is coupled to the feed system so that a movement of the feed system in the feed direction brings the second blocking means into or maintains it in the non-blocking position.

The aforementioned couplings of both blocking means with the closing device on the one hand and with the feed system on the other, assure, in a simple way, that the feed system is not blocked during firing. It should be remembered here that during the firing phase the closing device is normally closed.

The above-described coupling of the second blocking means with the feed system also allows the former to be unblocked safely and without unnecessary additional movement from a blocked position caused by a cartridge gap. The cartridge gap should, in this case, be moved back in the feed direction under the load opening. Thus, the feed system must be moved only the amount that would be required for filling the cartridge gap. Overall, this considerably facilitates filling the magazine without gaps and without requiring special attention on the rifleman's part.

Especially preferable is a mechanical locking engagement of both blocking means with the feed system, including the cartridges stored in the same. A mechanical locking engagement has proven especially immune to outside influences under rough battle conditions, In this case the first blocking means preferably engages a cartridge in the magazine, while the second blocking means engages an element of the cartridge receiving device, for example, one of the aforementioned crossbars.

Filling of the cartridge receiving device after the blocking engagement has taken place is facilitated by such an arrangement of the blocking means in which the first cartridge place after the place of blocking engagement in the feed direction is always located exactly under the load opening.

Further preferred embodiments of the invention and their respective advantages are explained in the following description of specific examples of embodiments with the help of the enclosed drawing.

DETAILED DESCRIPTION OF THE PREFERRED EMBODIMENT

Magazine 2 consists of a casing 4, basically of rectangular shape with rounded corners. A cartridge receiving device in the form of an endless chain 6 is movably guided in its longitudinal direction in casing 4. Perpendicularly to its longitudinal direction, chain 6 has crossbars 10, articulated to the chain links not shown in the figure. The distance between crossbars 10 is such that is exactly accommodates a cartridge 12.

Figure 5:
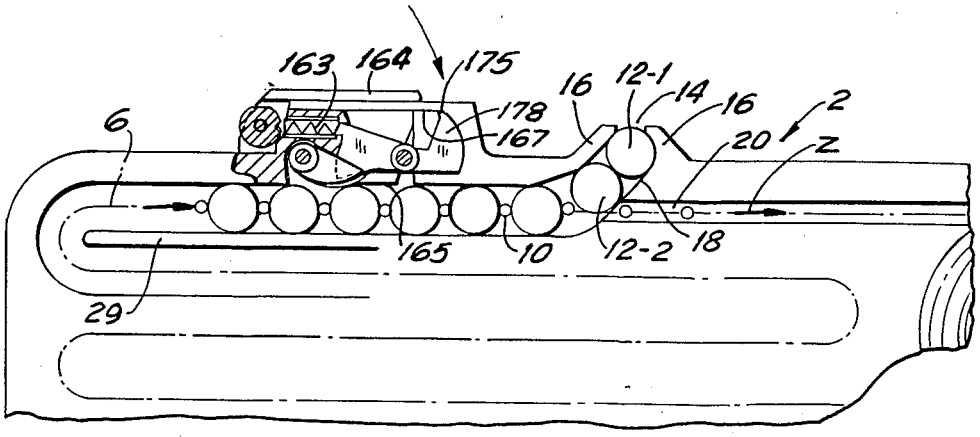
FIG. 5 a partial view, in which the load opening is closed by the closing device and thus the blocking means is disabled in the feed direction.

In FIG. 5 magazine 2 is loaded and a cartridge 12-1 contacts magazine lips 16. It has left the area between crossbars 10 of chain 6. The next cartridge 12-2 is conveyed from this area by a deflecting surface 18 and it is now in contact with only one of crossbars 10. A channel 20 is provided in the area of deflecting surface 18, allowing passage of crossbars 10.

Chain 6 of the example of embodiment can receive 150 cartridges 12. In addition, six blind cartridges are firmly fastened to the chain 6. As the chain 6 moves in the feed direction f, these blind cartridges assure that the last cartridge 12 will rest on the magazine lips 16. Thus the first blind cartridge in the feed direction Z assumes the position of cartridge 12-2 shown in FIG. 5, being movably and firmly attached to one of the crossbars 10.

After the last cartridge 12-1 has been fired, the firm attachment of the blind cartridge to the chain 6 prevents the cartridge from being returned to feed channel 15. Channel 20, designed for the crossbars only, forms a stop for the blind cartridges, stopping the movement of chain 6 in the feed direction. Thus the last blind cartridge in the feed direction 7 Z guarantees that drop lever 180 does not assume its normal position and thus the chain 6 can start moving immediately in the load direction B. Finally, when the magazine is fully loaded, the first cartridge in the load direction B runs against a stop and thus stops the movement of the chain in the load direction. Endless chain 6 runs through the inside of casing 4 in a meandering manner, being guided through guide grooves in both magazine walls 35 running parallel to the plane of the figure. The chain links, not represented, engage into these guide grooves. Guide grips 29 also serve for guiding the cartridges in magazine 2.

In a preferred example of embodiment a cylindrical drive wheel 32, with suitably designed teeth 33 engages into crossbars 10 of chain 6. The drive wheel 32 is subjected to a rotating moment acting in feed direction Z by a flat spiral spring 50. By pre-stressing spring 50, it is assured that the last cartridge 12 is pressed by chain 6 and the blind cartridges onto magazine lips 16. Rotating head 56, located outside casing 4, is coaxial and rotates solidarily with drive wheel 32. It serves as a handle for the rifle man to move chain 6 when loading the magazine.

At the top of magazine 2 (FIG. 1) at a short distance to the left from discharge opening 14 is a shaft-shaped load opening 160 for introducing cartridges 12 into magazine 2. Load opening 160 is closable via an articulated cover 164 movable in direction C indicated by the arrow. In FIGS. 1 through 4 this cover 164 is in its open position. In this position the rifleman can introduce individual cartridges 12 manually into load opening 160, from where they fall by gravity into the magazine 2. In FIG. 5 the cover is shown in its closed position. In this position cover 164 engages a limit force lock bolt 163 and is held fast by it. Face 165 of a projection 166 protruding from the internal surface 167 of cover 164 forms an extension of the path through which cartridges 12 are guided in the magazine.

Blocking means are provided in load opening 160, which together form a blocking device.

The first blocking means has a spring-loaded two-armed lever 170, which is rotatable up to an axis 171 perpendicular to the plane of the drawing. Axis 171 is located on the side facing the feed direction Z of load opening 160. Lever 170 has a serrated first lever arm 174 and a second lever arm 178. On the bottom side of the second lever arm 178, there is engaged helical spring 172. Helical spring 172 pre-tensions lever 170 in the counterclockwise direction of rotation. This makes first lever arm 174, located to the left of axis 171 on FIG. 2 fall onto the path of cartridges 12 and block their further movement in the feed direction Z with their front surface 176 acting as a stop.

When the rifleman closes cover 164 of load opening 160 (FIG. 5) after loading the magazine, the free end of the cover bottom 167 contacts projection 175 of second lever arm 178 of two-arm lever 170. This makes two-armed lever 170 rotates clockwise, i.e., against the resetting force of helical spring 172, until its first lever arm 174 fully moves out of the path of cartridges 12. Thus when cover 164 is closed, the first blocking means is disabled.

Longitudinal surface 177 of first lever arm 174, facing chain 6, is shaped as an oblique plane surface or a convex surface. Thus when the chain moves in the load direction B, first lever arm 174 rotates upwards from cartridges 12 on chain 6 against the resetting force of helical spring 172 and slides on said cartridges 12.

Thus, the first blocking means always allows chain 6 to move—with or without cartridges 12—in the load direction B, but blocks during the loading phase, i.e., when cover 164 is open, its movement in the feed direction Z. Thus, during the loading phase, the rifleman can always rotate rotating head 56 counterclockwise with one hand and thus move chain 6 in the load direction B, while feeding chain 6, with the other hand, with cartridges 12 through load opening 160 and, after one rotating movement by hand, gripping rotating head 56 again to rotate it again.

Figure 1:
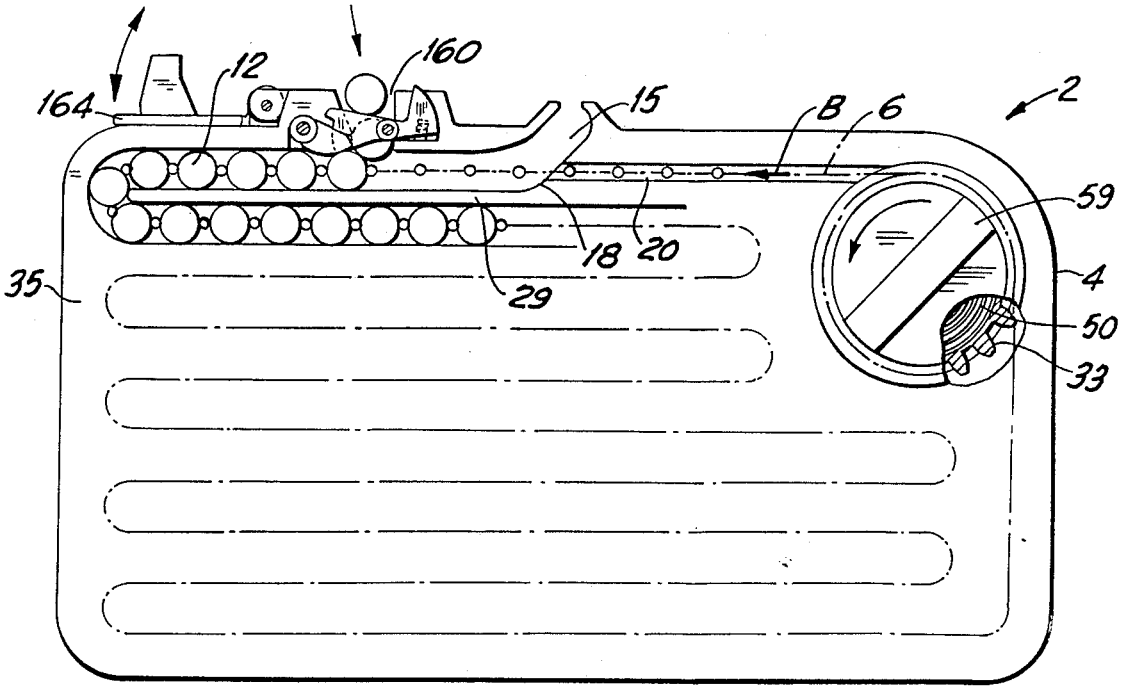
FIG. 1 a partially sectioned side view of an example of embodiment of a magazine, with manual loading of cartridges.
Figure 2:
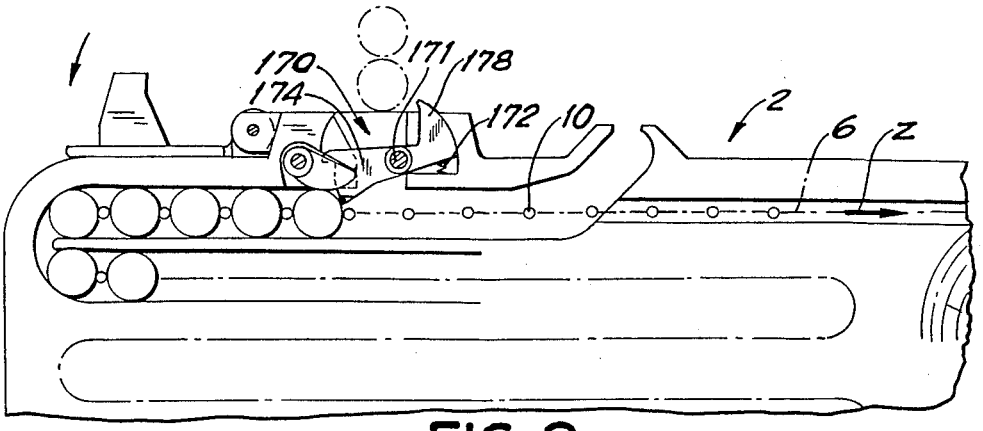
FIG. 2 is a partial view of the area of the magazine in the upper left portion of FIG. 1, in which a first blocking means blocks the movement of the cartridge receiving device in the feed direction.
Figure 3:
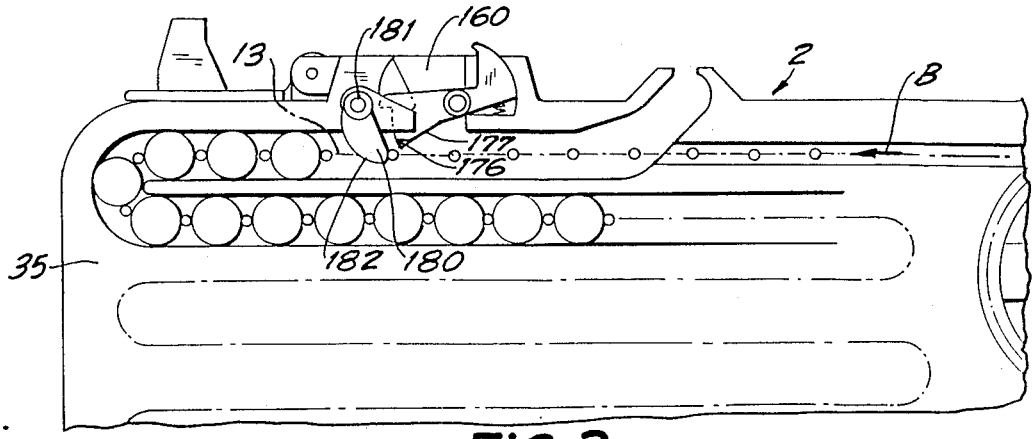
FIG. 3 a partial view of FIG. 2, in which a second blocking means blocks the movement of the cartridge receiving device in the load direction.
Figure 4:
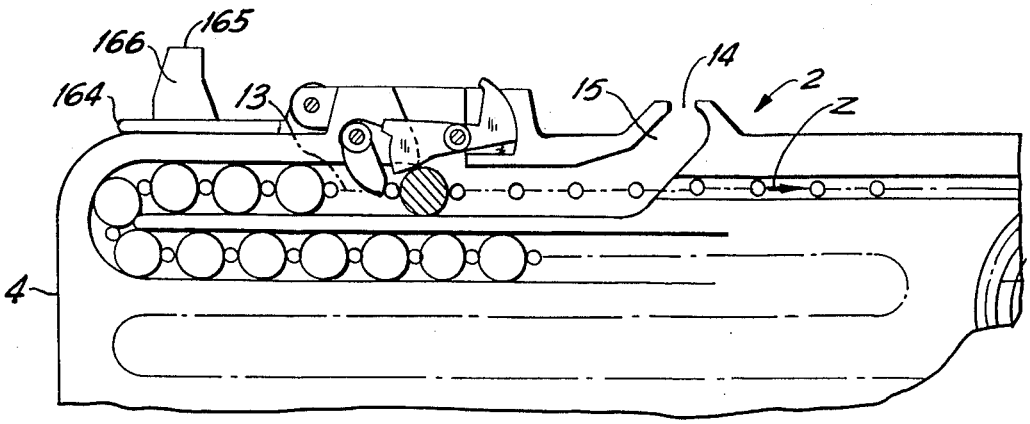
FIG. 4 a partial view of FIG. 3, in which a cartridge was manually loaded, and a gap was created.

If no more cartridges 12 are supplied in the loading phase, or a major delay occurs between the introduction of the individual cartridges 12 into load opening 160, and the rifleman moves chain 6 on too quickly in the load direction B, the second blocking means engages into chain 6. This engagement prevents further chain movement in the load direction B. The second blocking means has a lever arm 180 in the form of a drop lever rotating around an axis 181 located above chain 6, behind load opening 160 in the load direction B. If the gap between two crossbars 10 reaches the area under drop lever 180 without having received a cartridge when passing through load opening 160, drop lever 180 falls onto the path of crossbars 10 and stops further movement of chain 6 in the load direction B. For this purpose, lever arm 180 can rotate only within a limited range and forms a stop for the oncoming crossbar 10 (FIG. 3).

If the chain is blocked, a gap appears between two crossbars under load opening 160, so that another cartridge can be placed into the chain, where a cartridge gap 13 has been formed. Introduction of further cartridges into chain 6 presumes the filling of these gaps 13. For this purpose, empty gap 13 must be conveyed under load opening 160. This is done by releasing rotationg head 56: the chain moves by the driving force of spring 50 in the feed direction Z, which makes the last cartridge present in the magazine swivel the drop lever from its locking position, on its longitudinal surface 182, which is a convex surface in the example of embodiment.

Now this cartridge hits a surface 176 on lever arm 174 of the first block means, the length of the lever arm being designed so that when the chain is blocked, cartridge gap 13 is conveyed precisely under load opening 160. Thus, if a cartridge gap 13 is formed during loading, chain 6 can move back and forth only within a distance corresponding to cartridge gap 13.

After filling cartridge gap 13, the rifleman can move chain 6 in the load direction B again and load further cartridges 12. Thus, the second blocking means causes cartridge gap 13 to be automatically detected and eliminated.

We claim:

1. A magazine having a load opening and comprising:

a linkless cartridge feed system provided with means for manual loading with cartridges through the load opening, and means for automatic and sequential feed of cartridges to a firearm barrel, said feed system including a cartridge receiving device movable manually in a loading direction and automatically in an opposite feed direction;

a tensioning device engaged with said cartridge receiving device in said feed direction; and a blocking means comprising first means for an automatic blocking of the feed system in the feed direction, during a loading phase of operation, and second means operated independently from and nonsimultaneously with said first means for an automatic blocking of the feed system in the loading direction when a cartridge is missing in the cartridge receiving device.

2. Magazine according to claim 1, and further comprising a closing device for closing the load opening, the first blocking means being operatively connected to the closing device so that the first blocking means can be brought to and maintained in an unlocked closed position by the closing device.

3. Magazine according to claim 2, wherein the first blocking means has a first lever arm and a tension spring which swivels the first lever arm into a path of a cartridge movement in the magazine, the first lever arm being serrated at a free end thereof and has at said end a contact surface acting as an abutment stop for a cartridge in the magazine and moving in the feed direction, and an oblique surface acting as a slide surface for the cartridges in the magazine.

4. Magazine according to claim 3, wherein the closing device provided for the load opening is constructed so that in a closed position thereof it holds the first lever arm against the force of the tension spring outside the path of movement of the cartridges in the magazine.

5. Magazine according to claim 4, wherein the first blocking means further includes a second lever arm connected to the first lever arm, said first and second lever arms being located on two opposite sides of a common axis of rotation thereof, said common axis of rotation being located on a side of the load opening facing the feed direction, said tension spring being a helical spring engaging with the second lever arm and the closing device including a flap cover, which in a closed position thereof presses the second lever arm against the helical spring.

6. Magazine according to claim, 1 wherein the second blocking means is operatively connected to the feed system so that the second blocking means can be brought to and maintained in an unlocked position when the feed system is moved in the feed direction.

7. Magazine according to claim 1, wherein at least one of the first blocking means and the second blocking means is constructed for a mechanical locking engagement with the feed system.

8. Magazine according to claim 7, wherein the first blocking means is constructed for a locking engagement with cartridges located in the magazine and the second blocking means is constructed for a locking engagement with cartridge-holding elements of the cartridge receiving device.

9. Magazine according to claim 8, wherein the second blocking means includes a lever arm swivelable into a cartridge gap and away from said cartridge gap.

10. Magazine according to claim 9, wherein the lever arm of said second blocking means is a drop lever located above the cartridges in the magazine.

11. Magazine according to claim 9, wherein said lever arm of said second blocking means is constructed so that it is swiveled out of a cartridge gap of a first cartridge in the feed direction and slides on the cartridges in an area of the load opening.

12. Magazine according to claim 11, wherein said lever arm of said second blocking means includes a convex surface which slides on the cartridges.

13. Magazine according to claim 9, wherein a swivel axis of said lever arm of said second blocking means is arranged on a side of the load opening facing said loading direction.

* * * * *